US011580915B2

(12) United States Patent
Cho et al.

(10) Patent No.: US 11,580,915 B2
(45) Date of Patent: Feb. 14, 2023

(54) DATA DRIVING CIRCUIT AND DISPLAY DEVICE

(71) Applicant: LG DISPLAY CO., LTD., Seoul (KR)

(72) Inventors: ByoungChul Cho, Paju-si (KR); Jiwon Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/471,650

(22) Filed: Sep. 10, 2021

(65) Prior Publication Data

US 2022/0139334 A1 May 5, 2022

(30) Foreign Application Priority Data

Nov. 4, 2020 (KR) ..... 10-2020-0146388

(51) Int. Cl.
*G09G 3/3291* (2016.01)

(52) U.S. Cl.
CPC ... *G09G 3/3291* (2013.01); *G09G 2300/0452* (2013.01); *G09G 2310/027* (2013.01); *G09G 2320/0666* (2013.01)

(58) Field of Classification Search
CPC ..... G09G 3/3291; G09G 2300/0452; G09G 2310/027; G09G 2320/0666
See application file for complete search history.

(56) References Cited

U.S. PATENT DOCUMENTS

2015/0339967 A1* 11/2015 Shin ..... G09G 3/2003 345/690
2019/0237027 A1* 8/2019 Zhou ..... G09G 3/3406

* cited by examiner

*Primary Examiner* — Kenneth B Lee, Jr.
(74) *Attorney, Agent, or Firm* — Morgan, Lewis & Bockius LLP

(57) ABSTRACT

Embodiments of the present disclosure relate to a data driving circuit and a display device. In the process of a display device converting an image data received from an outside into a data signal supplied to a data driving circuit, a final color temperature target represented by the image is variably set based on a panel driving current, so that the power consumption of a display panel displaying an image can be minimized. In addition, since the final color temperature target is varied, the luminance of the image and the user's recognition level are maintained constant, thereby improving the efficiency of the display device.

16 Claims, 10 Drawing Sheets

| Color Temp. | Panel Driving Current |
|---|---|
| 10,500K | 7.2A |
| 10,250K | 7.1A |
| **10,000K** | **7A** |
| 9,750K | 6.9A |
| **9,500K** | **6.8A** |
| 9,250K | 6.85A |

[Power consumption by color temp. of image A]

[Color temp. change over time]

| Color Temp. | Panel Driving Current |
|---|---|
| 10,500K | 7.1A |
| 10,250K | 7A |
| **10,000K** | **6.8A** |
| **9,750K** | **6.7A** |
| 9,500K | 6.8A |
| 9,250K | 6.9A |

[Power consumption by color temp. of image B]

[Color temp. change over time]

DATA DRIVING CIRCUIT AND DISPLAY DEVICE

CROSS REFERENCE TO RELATED APPLICATION

This application claims priority from Korean Patent Application No. 10-2020-0146388, filed on Nov. 4, 2020, which is hereby incorporated by reference for all purposes as if fully set forth herein.

TECHNICAL FIELD

The present disclosure relates to a data driving circuit and a display device.

DISCUSSION OF THE RELATED ART

The growth of the information society leads to increased demand for display devices to display images and use of various types of display devices, such as liquid crystal display devices, organic light emitting display devices, etc.

The display device may include a display panel in which a plurality of subpixels, signal lines and voltage lines are disposed, and various driving circuits for driving the display panel.

The display device may control the luminance represented by the subpixel by controlling the amount of current supplied to the subpixel according to the type, and display an image through the display panel. In this case, as the amount of total current supplied to the display panel increases, the power consumption of the display device increases. Therefore, there is required a method for displaying an image while minimizing the increase in power consumption.

SUMMARY

Accordingly, embodiments of the present disclosure are directed to a data driving circuit and a display device that substantially obviate one or more of the problems due to limitations and disadvantages of the related art.

An aspect of the present disclosure is to provide a manner capable of minimizing power consumption according to the image displayed by a display panel and improving the efficiency of the display panel.

Another aspect of the present disclosure is to provide a manner capable of displaying an image in which the power consumption of a display device is minimized and preventing the user from recognizing a difference in the displayed image according to the minimization of power consumption.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device including a display panel on which a plurality of pixels are disposed, each of the plurality of pixels including a red subpixel, a green subpixel, a blue subpixel and a white subpixel, a data driving circuit for supplying a data voltage to the plurality of pixels, and a controller for controlling the data driving circuit.

A color temperature measured when the display panel displays a first image may be a first color temperature. In addition, a color temperature measured when the display panel displays a second image may be a second color temperature different from the first color temperature.

A first panel driving current supplied to the display panel when displaying the first image in the first color temperature may be less than or equal to a second panel driving current supplied to the display panel when displaying the first image in the second color temperature.

In addition, a third panel driving current supplied to the display panel when displaying the second image in the second color temperature may be less than or equal to a fourth panel driving current supplied to the display panel when displaying the second image in the first color temperature.

A data voltage supplied to a pixel representing a test grayscale among the plurality of pixels in the first image may be different from a data voltage supplied to a pixel representing the test grayscale among the plurality of pixels in the second image.

A luminance of the pixel representing the test grayscale in the first image may be the same as a luminance of the pixel representing the test grayscale in the second image.

A color temperature measured when the display panel displays a third image may be a third color temperature, and the third color temperature may be included between the first color temperature and the second color temperature.

The third color temperature measured when the display panel displays a third image may be equal to one of the first color temperature and the second color temperature.

In another aspect, embodiments of the present disclosure may provide a data driving circuit for receiving a data signal from a controller and outputting a data voltage to a plurality of pixels disposed on a display panel, wherein a data voltage output to a pixel representing a test grayscale among the plurality of pixels in response to a first data signal is different from a data voltage output to a pixel representing the test grayscale among the plurality of pixels in response to a second data signal.

According to embodiments of the present disclosure, it is possible to display image while reducing a power consumption of a display panel by calculating a panel driving current according to a color temperature of the image displayed by the display panel and displaying the image with the color temperature at which the panel driving current is the minimum.

According to embodiments of the present disclosure, it is possible to reduce a power consumption of a display device while preventing an user from recognizing the difference in images by selecting a color temperature for minimizing a panel driving current from among the candidates of the predetermined color temperature and displaying an image according to the selected color temperature.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
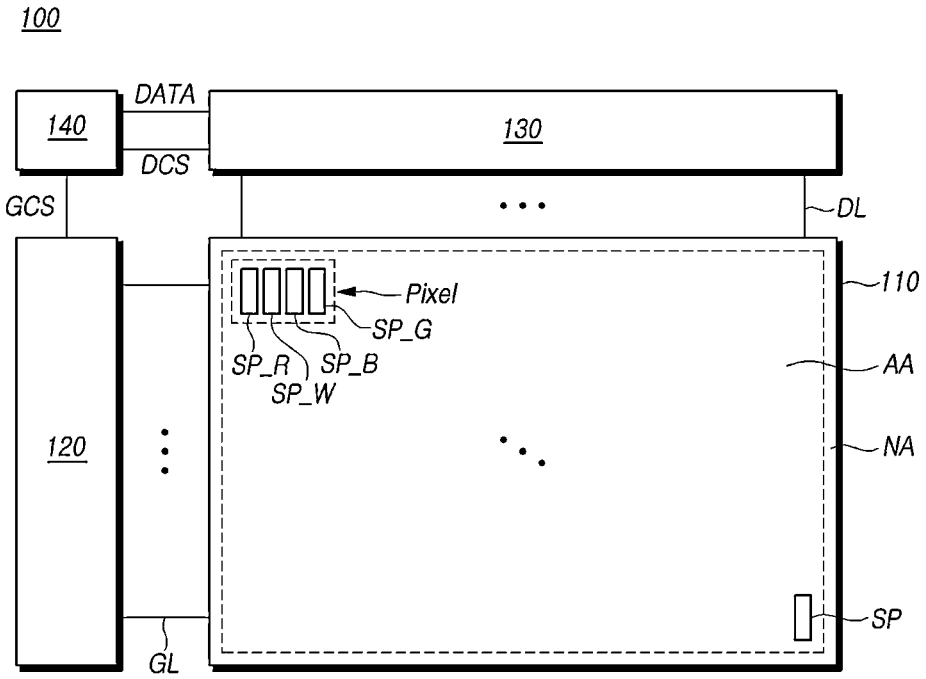
FIG. 1 schematically illustrates a configuration of a display device according to embodiments of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 schematically illustrates a configuration included in a display device 100 according to embodiments of the present disclosure.

Referring to FIG. 1, the display device 100 may include a display panel 110, a gate driving circuit 120, a data driving circuit 130 and a controller 140 for driving the display panel 110.

The display panel 110 may include an active area AA in which a plurality of subpixels SP are disposed, and a non-active area NA positioned outside the active area AA.

A plurality of gate lines GL and a plurality of data lines DL may be disposed on the display panel 110. The subpixel SP may be positioned in a region where the gate line GL and the data line DL intersect.

The gate driving circuit 120 is controlled by the controller 140. The gate driving circuit 120 can sequentially output scan signals to the plurality of gate lines GL arranged on the display panel 110, thereby controlling the driving timing of the plurality of subpixels SP.

The gate driving circuit 120 may include one or more gate driver integrated circuits GDIC. The gate driving circuit 120 may be located only at one side of the display panel 110, or can be located at both sides thereof according to a driving method.

Each gate driver integrated circuit GDIC may be connected to a bonding pad of the display panel 110 by a tape automated bonding (TAB) method or a chip-on-glass (COG) method. Alternatively, each gate driver integrated circuit GDIC may be implemented as a to gate-in-panel (GIP) type and disposed directly on the display panel 110. Alternatively, each gate driver integrated circuit GDIC may be integrated and disposed on the display panel 110 in some cases. Alternatively, each gate driver integrated circuit GDIC may be implemented in a chip-on-film (COF) method and mounted on a film connected to the display panel 110.

The data driving circuit 130 may receive data signal from the controller 140 and converts the data signal into an analog data voltage Vdata. The data driving circuit 130 outputs the data voltage Vdata to each data line DL according to the timing at which the scan signal is applied through the gate line GL so that each of the plurality of subpixels SP emits light having brightness according to the data signal.

The data driving circuit 130 may include one or more source driver integrated circuits SDIC.

Each source driver integrated circuit SDIC may include a shift register, a latch circuit, a digital-to-analog converter, an output buffer, and the like.

Each source driver integrated circuit SDIC may be connected to a bonding pad of the display panel 110 by a tape automated bonding (TAB) method or a chip-on-glass (COG) method. Alternatively, each source driver integrated circuit SDIC may be disposed directly on the display panel 110. Alternatively, each source driver integrated circuit SDIC may be integrated and disposed on the display panel 110 in some cases. Alternatively, each source driver integrated circuit SDIC may be implemented in a chip-on-film (COF) manner. In this case, each source driver integrated circuit SDIC may be mounted on a film connected to the display panel 110, and may be electrically connected to the display panel 110 through lines on the film.

The controller 140 may supply various control signals to the gate driving circuit 120 and the data driving circuit 130, and control the operation of the gate driving circuit 120 and the data driving circuit 130.

The controller 140 may be mounted on a printed circuit board or a flexible printed circuit. The controller 140 may be electrically connected to the gate driving circuit 120 and the data driving circuit 130 through a printed circuit board or a flexible printed circuit.

The controller 140 may control the gate driving circuit 120 to output a scan signal according to timing implemented in each frame. The controller 140 may convert externally received image data to match a signal format used by the data driving circuit 130, and output to the converted data signal to the data driving circuit 130.

The controller 140 may receive various timing signals including a vertical synchronization signal VSYNC, a horizontal synchronization signal HSYNC, an input data enable signal DE, a clock signal CLK from the outside (e.g., host system).

The controller 140 may generate various control signals by using various timing signals received from the outside, and may output the control signals to the gate driving circuit 120 and the data driving circuit 130.

For example, in order to control the gate driving circuit 120, the controller 140 may output various gate control signals GCS including a gate start pulse GSP, a gate shift clock GSC, and a gate output enable signal GOE.

Here, the gate start pulse GSP controls operation start timing of one or more gate driver integrated circuits GDIC constituting the gate driving circuit 120. The gate shift clock GSC, which is a clock signal commonly input to one or more gate driver integrated circuits GDIC, controls the shift timing of a scan signal. The gate output enable signal GOE specifies timing information on one or more gate driver integrated circuits GDIC.

In addition, in order to control the data driving circuit 130, the controller 140 may output various data control signals DCS including a source start pulse SSP, a source sampling clock SSC, a source output enable signal SOE, or the like.

Here, the source start pulse SSP controls a data sampling start timing of one or more source driver integrated circuits SDIC constituting the data driving circuit 130. The source sampling clock SSC is a clock signal for controlling the timing of sampling data in the respective source driver integrated circuits SDIC. The source output enable signal SOE controls the output timing of the data driving circuit 130.

The display device 100 may further include a power management integrated circuit for supplying various voltages or currents to the display panel 110, the gate driving circuit 120, the data driving circuit 130, and the like or controlling various voltages or currents to be supplied thereto.

Each subpixel SP may be a region defined by the intersection of the gate line GL and the data line DL, in which at least one circuit element including a light emitting device may be disposed.

For example, in the case that the display device 100 is an organic light emitting display device, an organic light emitting diode OLED and various circuit elements may be disposed in the plurality of subpixels SP. The display device 100 controls the current supplied to the organic light emitting diode OLED disposed in the subpixel SP by driving several circuit elements, so that each subpixel SP may be controlled to display brightness corresponding to image data.

Alternatively, in some cases, a light emitting diode (LED) or a micro light emitting diode (pLED) may be disposed in the subpixel SP.

Two or more sub-pixels SP may constitute one pixel. For example, the pixel may include a red subpixel SP_R, a green subpixel SP_G, and a blue subpixel SP_B. Alternatively, in some cases, the pixel may further include a white subpixel SP_W.

In this case, the position at which the white subpixel SP_W included in the pixel is disposed within the pixel may vary depending on the type of the display device 100.

Figure 2:
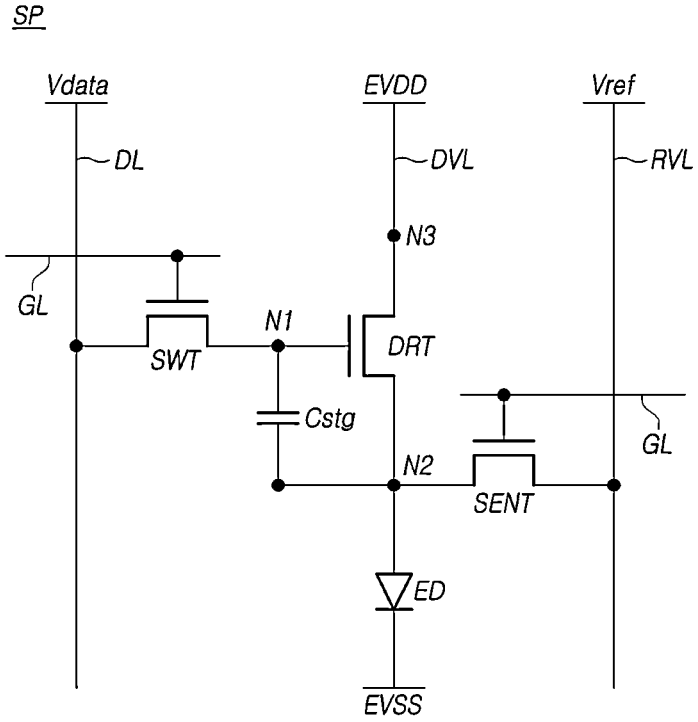
FIG. 2 illustrates an example of a circuit structure of a subpixel included in a display device according to embodiments of the present disclosure.

FIG. 2 illustrates an example of a circuit structure of the subpixel SP included in the display device 100 according to embodiments of the present disclosure.

Referring to FIG. 2, a light emitting device ED and a driving transistor DRT for driving the light emitting device ED may be disposed in the subpixel SP. In addition, at least one circuit components may be disposed in the subpixel SP in addition to the driving transistor DRT.

For example, as illustrated in FIG. 2, a switching transistor SWT, a sensing transistor SENT, and a storage capacitor Cstg may be further disposed in the subpixel SP.

Accordingly, FIG. 2 illustrates an example of the 3T1C structure in which three thin film transistors and one capacitor are disposed in addition to the light emitting device ED. However, embodiments of the present disclosure are not limited thereto. In addition, FIG. 2 illustrates a case in which all of the thin film transistors are N-type as an example, but in some cases, the thin film transistors disposed in the subpixel SP may be P-type.

The switching transistor SWT may be electrically connected between the data line DL and a first node N1.

The data voltage Vdata may be supplied to the subpixel SP through the data line DL. The first node N1 may be a gate node of the driving transistor DRT.

The switching transistor SWT may be controlled by a scan signal supplied to the gate line GL. The switching transistor SWT may control that the data voltage Vdata supplied through the data line DL is applied to the gate node of the driving transistor DRT.

The driving transistor DRT may be electrically connected between a driving voltage line DVL and a light emitting device ED.

A first driving voltage EVDD may be supplied to a third node N3 of the driving transistor DRT through a driving voltage line DVL. The first driving voltage EVDD may be a high potential driving voltage. The third node N3 may be a drain node or a source node of the driving transistor DRT.

The driving transistor DRT may be controlled by a voltage applied to the first node N1. In addition, the driving transistor DRT may control the driving current supplied to the light emitting device ED.

The sensing transistor SENT may be electrically connected between the reference voltage line RVL and a second node N2.

The reference voltage Vref may be supplied to the second node N2 through the reference voltage line RVL. The second node N2 may be a source node or a drain node of the driving transistor DRT.

The sensing transistor SENT may be controlled by a scan signal supplied to the gate line GL. The gate line GL controlling the sensing transistor SENT may be the same as or different from the gate line GL controlling the switching transistor SWT.

The sensing transistor SENT may control that the reference voltage Vref is applied to the second node N2. Also, in some cases, the sensing transistor SENT may control sensing the voltage of the second node N2 through the reference voltage line RVL.

The storage capacitor Cstg may be electrically connected between the first node N1 and the second node N2. The storage capacitor Cstg may maintain the data voltage Vdata applied to the first node N1 for one frame.

The light emitting device ED may be electrically connected between the second node N2 and a line supplying a second driving voltage EVSS. The second driving voltage EVSS may be a low potential driving voltage.

The light emitting device ED may express brightness according to the driving current supplied through the driving transistor DRT.

There may be determined the power consumption of the display panel 110 depending on the sum of driving currents supplied to the light emitting devices ED positioned in each of the plurality of subpixels SP disposed in the display panel 110. That is, when the display panel 110 displays an image, power consumption may be determined according to the panel driving current supplied to the display panel 110.

Embodiments of the present disclosure may reduce the panel driving current supplied to the display panel 110 in order to display a corresponding image while maintaining the luminance of the image.

For example, the display device 100 may calculate the panel driving current according to a color temperature of an image displayed by the display panel 110. The display device 100 may set the color temperature at which the calculated panel driving current is the minimum, and may display the image according to the set color temperature.

The display device 100 may minimize the power consumption required for the display panel 110 to display the image by adjusting the color temperature within a certain range according to the image displayed by the display panel 110.

Figure 3:
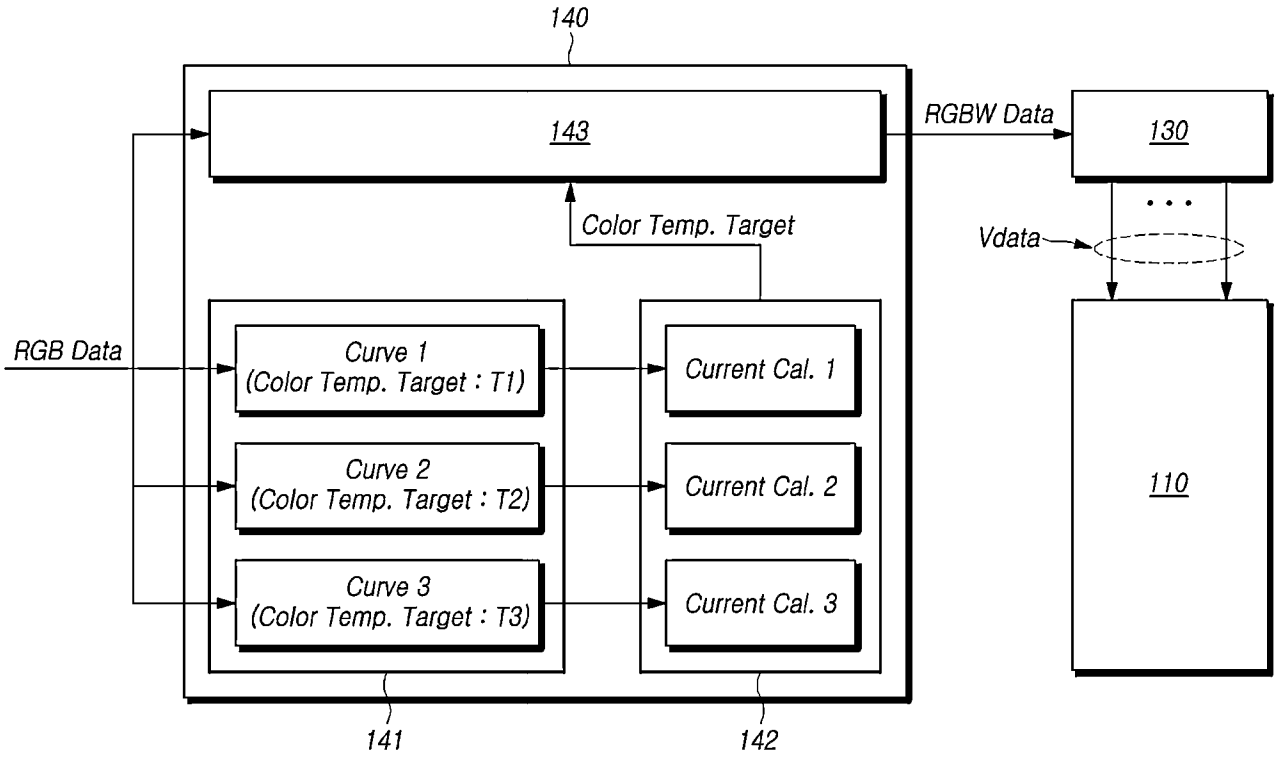
FIG. 3 illustrates an example of a configuration of setting a color temperature of an image by a display device according to embodiments of the present disclosure.

FIG. 3 illustrates an example of a configuration of setting a color temperature of an image by a display device 100 according to embodiments of the present disclosure.

Referring to FIG. 3, the controller 140 of the display device 100 may receive image data, convert the received image data into a data signal, and output the data signal to the data driving circuit 130.

The controller 140 may select a data signal capable of minimizing power consumption of the display panel 110 according to the data signal in the process of converting the image data into the data signal.

For example, a pixel disposed on the display panel 110 may include a red subpixel SP_R, a green subpixel SP_G, a blue subpixel SP_B, and a white subpixel SP_W.

In this case, the controller 140 may receive red image data, green image data, and blue image data from the outside, and convert the received image data into red, green, blue, and white data signals.

The controller 140 may set a color temperature target in a process of converting the red, green, blue, and white data signals.

The controller 140 may reduce the power consumption of the display panel 110 when the display is driven according to the converted data signal by varying the color temperature target set when the data signal is converted in consideration of the panel driving current.

The controller 140 may include, for example, a candidate data converter 141, a driving current calculator 142, and a final data converter 143.

The candidate data converter 141 of the controller 140 may receive image data. The candidate data converter 141 may convert the received image data into a candidate data signal based on a conversion curve according to a color temperature.

As an example, in the case that the candidate color temperature targets which are candidates for the color temperature target are T1, T2, and T3, there may exist the conversion curves 1, 2, and 3 for each candidate color temperature target.

The conversion curve may be a curve used when converting red, green, and blue image data into red, green, blue, and white data signals.

The conversion curve, for example, may indicate values of red, green, and blue data corresponding to values of white data. That is, the conversion curve may represent red, green, and blue data having values equivalent to the values of white data.

In the case that the conversion curve is a conversion curve according to a high candidate color temperature target, since the amount of red data is small, the amounts of green data and blue data may be relatively large. In addition, if the conversion curve is a conversion curve according to a low candidate color temperature target, since the amount of red data is large, the amounts of green data and blue data may be relatively small.

The candidate data converter 141 may identify red, green, and blue data values corresponding to white data values based on conversion curves according to respective candidate color temperature targets, and may convert the red, green, and blue image data into the red, green, blue and white data signals. Here, the values of red, green, and blue data corresponding to the values of white data may mean values of red, green, and blue data having values equivalent to the values of white data.

Since values of red, green, and blue data corresponding to values of white data are different depending on a conversion curve, data signals converted from image data representing the same grayscale may be different. That is, the candidate data converter 141 may generate a plurality of candidate data signals from one image data.

If the candidate data signals are different, the panel driving current may be different when driving the display.

When the image data is converted into a plurality of candidate data signals by the candidate data converter 141, the driving current calculator 142 may calculate a panel driving current when driving the display using the converted candidate data signals.

The panel driving current may mean a current supplied to the display panel 110 when the data voltage Vdata according to the converted data signal is supplied to the display panel 110 and an image is displayed. The panel driving current may be confirmed by measuring, for example, a current flowing through the driving voltage line DVL supplying the first driving voltage EVDD to the display panel 110.

The driving current calculator 142 may calculate a panel driving current for each of the candidate data signals converted according to the candidate color temperature target, and compare the calculated panel driving currents.

The driving current calculator 142 may set a color temperature at which the panel driving current is minimized as a final color temperature target. Alternatively, in some cases, a separate logic may set the final color temperature target based on the panel driving current according to the candidate data signal calculated by the driving current calculator 142.

For example, in the case that the candidate color temperature targets T1, T2, and T3 are 10,500K, 10,000K, and 9,500K, respectively, and the panel driving currents according to the candidate color temperature targets T1, T2, and T3 are 7 A, 6.8 A, and 6.7 A, respectively, the final color temperature target may be set to 9,500K at which the panel driving current is the minimum.

The final data converter 143 may receive the image data from the outside and receive the final color temperature target from the driving current calculator 142.

The final data converter 143 may convert the red, green, and blue image data into red, green, blue, and white data signals based on the conversion curve according to the final color temperature target.

The final data converter 143 may output the converted red, green, blue, and white data signals to the data driving circuit 130.

The data driving circuit 130 may supply the data voltage Vdata according to the red, green, blue, and white data signals received from the controller 140 to the display panel 110.

The display panel 110 displays an image according to the data voltage Vdata supplied from the data driving circuit 130, and the color temperature of the image displayed by the display panel 110 may be a color temperature according to the final color temperature target set by the controller 140.

Since the final color temperature target is selected as a candidate color temperature target capable of minimizing the panel driving current among the candidate color temperature targets, if an image representing a color temperature according to the final color temperature target is displayed, the power consumption of the display panel 110 may be reduced.

As described above, in the embodiments of the present disclosure, when converting image data into a data signal, the final color temperature target may be set such that the panel driving current according to the converted data signal is minimized, so that it is possible to display an image while reducing power consumption of the display panel 110.

That is, an image may be displayed with a variable color temperature instead of a constant color temperature, so that the power consumption of the display panel 110 can be minimized and the efficiency of the display panel 110 can be improved.

In addition, since the final color temperature target is set from among the predetermined candidate color temperature targets, the image can be displayed while changing the color temperature in a range that is difficult for the user to recognize.

Figure 4:
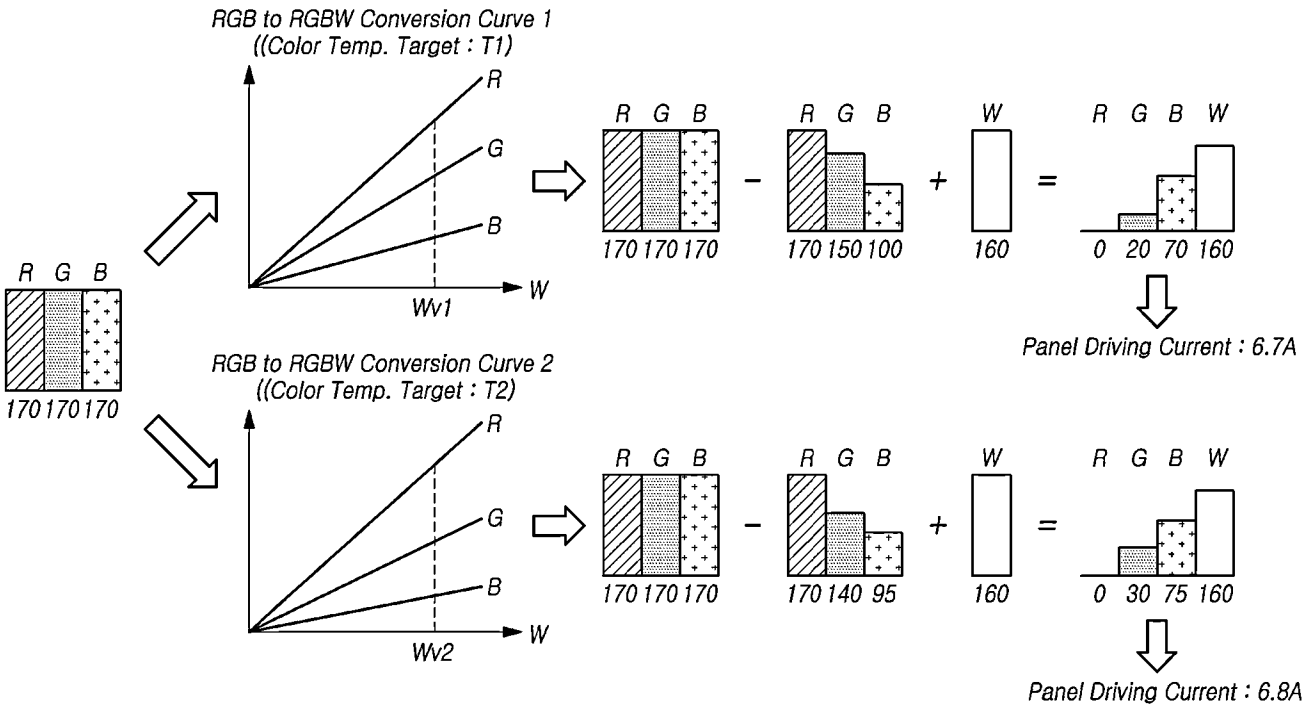
FIGS. 4 to 6 illustrate examples of a method of setting a color temperature of an image by a display device according to embodiments of the present disclosure.
Figure 5:
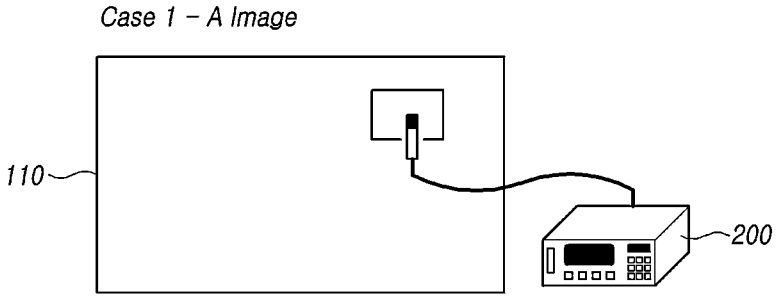
Figure 5:
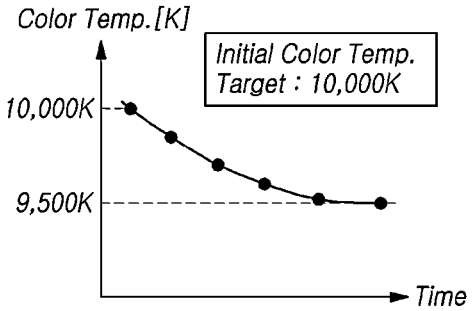
Figure 6:
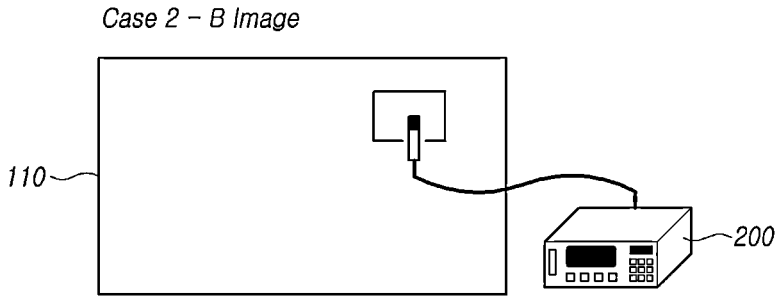
Figure 6:
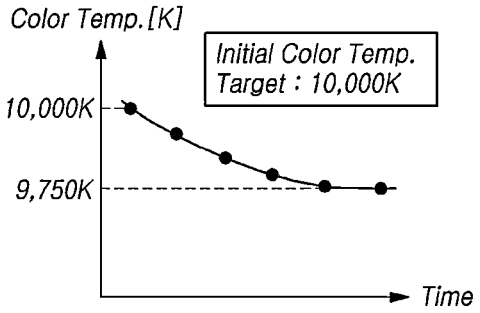

FIGS. 4 to 6 illustrate examples of a method of setting a color temperature of an image by a display device 100 according to embodiments of the present disclosure.

FIG. 4 illustrates an example in which the grayscales of the red image data, green image data and blue image data received from the outside by the controller 140 are 170, 170, and 170, respectively. Here, the image data represents, as an example, the grayscale corresponding to any one of the pixels disposed on the display panel 110.

For example, the controller 140 may convert red image data, green image data and blue image data into red data signal, green data signal, blue data signal, and white data signal according to a conversion curve 1 and a conversion curve 2.

W in FIG. 4 represents a value of the white data. The value of the white data according to the conversion curve 1 may be Wv1, and the value of the white data according to the conversion curve 2 may be Wv2. Wv1 and Wv2 may be the same or different depending on image data or a conversion curve, and FIG. 4 illustrates an example in which Wv1 and Wv2 are the same.

In the case that image data is converted according to the conversion curve 1, there may be checked the values of red, green, and blue data corresponding to the value 160 of white data. The values of red, green and blue data corresponding to the value 160 of white data according to the conversion curve 1 may be 170, 150 and 100, respectively.

According to the use of white data, the values 170, 150 and 100 of the red, green and blue data corresponding to the value 160 of the white data are subtracted from the values 170, 170, and 170 of the red, green, and blue data. The values of red, green, blue, and white data may be 0, 20, 70, or 160, respectively.

In the case that image data is converted according to the conversion curve 2, values of red, green, and blue data corresponding to a value of 160 of white data may be 170, 140, and 95, respectively.

Since the values 170, 140, and 95 of red, green, and blue data corresponding to the value of 160 of white data are subtracted according to the use of white data, the converted values of red, green, blue and white data may be 0, 30, 75, 160, respectively.

Since image data is converted based on different color temperature targets, data signals corresponding to the same grayscale may be different. Since the data signal is different, the data voltage Vdata supplied to the pixel may vary, and since the data voltage Vdata varies, the panel driving current of the display panel 110 may vary.

For example, in the case that the display is driven according to the conversion curve 1, the panel driving current may be 6.7 A. The panel driving current according to conversion curve 2 may be 6.8 A.

In this case, the controller 140 may set the final color temperature target to T1 and convert the red, green, and blue image data into red, green, blue and white data signals based on the conversion curve 1 according to T1.

The controller 140 may output a data signal converted according to the final color temperature target at which the panel driving current is minimized to the data driving circuit 130 to display an image, thereby reducing the power consumption of the display panel 110 in performing display driving.

In addition, the controller 140 may change the final color temperature target so that the panel driving current is minimized for each image. The controller 140 may output the converted data signal according to the changed final color temperature target.

Alternatively, in some cases, the controller 140 may set the final color temperature target for reducing the panel driving current at regular period and convert image data according to the set final color temperature target.

For example, the controller 140 may set the final color temperature target for every frame. Alternatively, the controller 140 may set the final color temperature target capable of minimizing the panel driving current for a specific number of frames (e.g., 10 frames).

The period for setting the final color temperature target by the controller 140 can be varied, so that it is possible to reduce the load on the controller 140 or to prevent a difference in an image according to a color temperature change from being recognized.

FIGS. 5 and 6 illustrate examples of setting a final color temperature target for each frame.

Case 1 of FIG. 5 illustrates an example in which the display panel displays image A.

The controller 140 may receive image data corresponding to image A, and convert the image data into a candidate data signal based on a conversion curve according to a candidate color temperature target.

The controller 140 may calculate a panel driving current according to the converted candidate data signal, and set a final color temperature target based on the calculated panel driving current.

As an example, the candidate color temperature target may be 9,250K, 9,500K, 9,750K, 10,000K, 10,250K, or 10,500K. When displaying the image A, the calculated panel driving current according to each candidate color temperature target may be 6.85 A, 6.8 A, 6.9 A, 7 A, 7.1 A, or 7.2 A.

The controller 140 may set 9,500K, at which the panel driving current is the minimum, as the final color temperature target, and convert the image data into a data signal based on the conversion curve according to the set final color temperature target and output the converted data signal.

The color temperature of the image A displayed by the display panel 110 driven according to the data signal converted by the controller 140 may be measured as 9,500K. In addition, if an initial color temperature target is set to 10,000K, it can be seen that the color temperature measured by the color temperature measuring device 200 changes to 9,500K as the image A is displayed.

That is, compared to the case of converting red, green, blue and white data according to 10,000K, which is a fixed initial color temperature target, and displaying an image, the final color temperature target varies depending on the image and red, green, blue and white data are converted and the image is displayed, so that it is possible to reduce the power consumption of the display panel 110.

In addition, the efficiency of the display panel 110 may be improved by varying the final color temperature target within a predetermined range according to an image displayed by the display panel 110.

Case 2 of FIG. 6 illustrates an example in which the display panel 110 displays the image B.

When receiving red, green, and blue image data corresponding to the image B, the controller 140 may convert the received image data into a candidate data signal based on a conversion curve according to a candidate color temperature target.

The controller 140 may calculate a panel driving current according to the converted candidate data signal and set a final color temperature target.

For example, in the case of image B, if the final color temperature target is set to 9,750K, the panel driving current may be the minimum as 6.7 A.

The controller 140 may set the final color temperature target to 9,750K, and convert the red, green, and blue image data into red, green, blue and white data signals based on the conversion curve according to the set final color temperature target.

The data driving circuit 130 may output the data voltage Vdata according to the red, green, blue, and white data signals converted by the controller 140.

The display panel 110 may display the image B according to the data voltage Vdata output by the data driving circuit 130. The color temperature of the image B displayed by the display panel 110 may be measured as 9,750K by the color temperature measuring device 200.

As such, by differentiating the final color temperature target when the display panel 110 displays the A image and the B image, the panel driving current according to the displayed image can be minimized and the display panel 110 can reduce power consumption.

Since the final color temperature target of the image displayed by the display panel 110 is adjusted and power consumption is reduced, the luminance of pixels representing the same greyscale in the display panel 110 can be constantly maintained and the the power consumption can be reduced.

That is, the ratio of the data voltage Vdata supplied to the pixel is changed according to the final color temperature target, so that the panel driving current can be reduced, but the luminance displayed by the display panel 110 can be constantly maintained.

Figure 7:
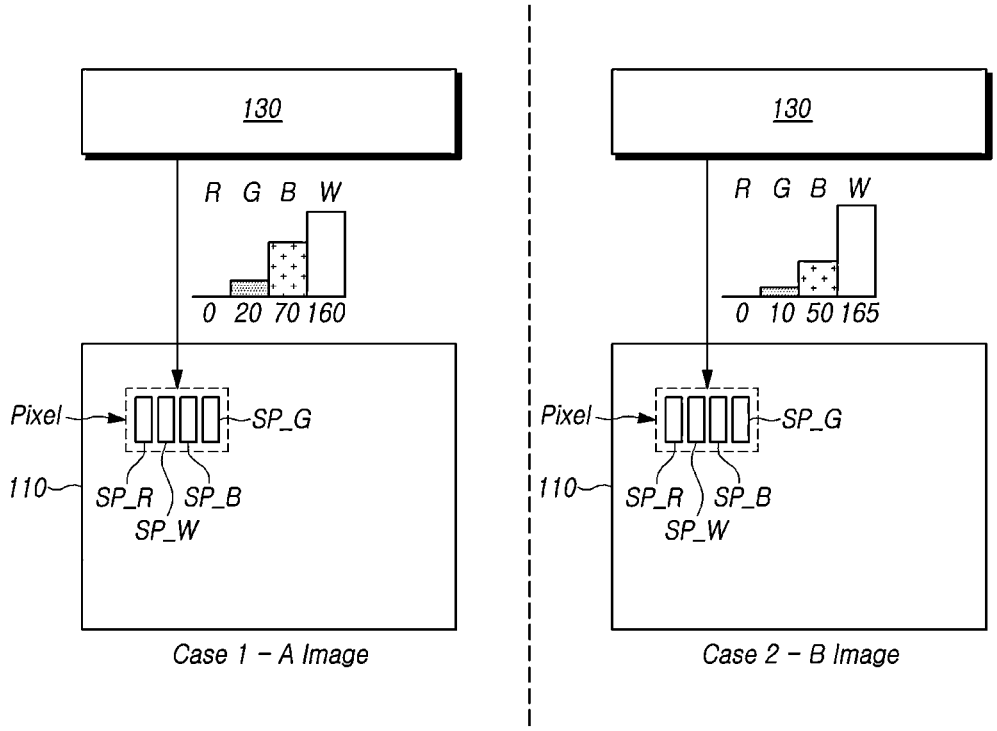
FIG. 7 illustrates an example in which a data voltage output from a data driving circuit is adjusted as a display device sets a color temperature of an image according to embodiments of the present disclosure.

FIG. 7 illustrates an example in which a data voltage Vdata output from a data driving circuit 130 is adjusted as a display device 100 sets a color temperature of an image according to embodiments of the present disclosure.

Referring to FIG. 7, the color temperature measured when the display panel 110 displays the image A and the color temperature measured when the image B is displayed may be different from each other. That is, when each image is displayed, the color temperature capable of minimizing the panel driving current may be set as the final color temperature target.

Even if the color temperature of the image A and the color temperature of the image B are different, the luminance of pixels representing the same grayscale may be the same.

For example, a pixel representing the same grayscale in the image A and the image B is referred to as a pixel representing the test grayscale. The positions of the pixels representing the test grayscale in the image A and the image B may be the same or different.

The data voltage Vdata supplied to the pixel representing the test grayscale in the image A may be determined based on the red data signal 0, the green data signal 20, the blue data signal 70, and the white data signal 160.

The data voltage Vdata supplied to the pixel representing the test grayscale in the image B may be determined based on the red data signal 0, the green data signal 10, the blue data signal 50, and the white data signal 165.

The luminance of the pixel representing the test greyscale in the image A and the luminance of the pixel representing the test greyscale in the image B may be the same.

By differentiating the final color temperature target when displaying the A image and the final color temperature target when displaying the B image, the panel driving current can be minimized while constantly maintaining the luminance of the pixel representing the test greyscale.

The ratio of red, green, blue, and white data according to the final color temperature target may vary, so that it is possible to maintain a constant luminance and reduce power consumption.

For example, in the case that the final color temperature target is relatively low, since a conversion curve having a small amount of green and blue data corresponding to a value of white data is used, in the data voltage Vdata supplied to the pixel, values of white data may decrease and values of green and blue data may increase. (Case 1—the image A)

As another example, if the final color temperature target is relatively high, there may be used a conversion curve having a large amount of green and blue data corresponding to a value of white data. Accordingly, in the data voltage Vdata supplied to the pixel, values of white data may increase and values of green and blue data may decrease. (Case 2—the image B)

The above-described method is an example, and according to the type of the conversion curve used to set the final color temperature target, the ratio of the values of red, green, blue, and white data according to the final color temperature target may be set differently from the above-described method.

In addition, in some cases, the display device 100 according to embodiments of the present disclosure may set the final color temperature target using an interpolation method and display an image according to the set final color temperature target.

Figure 8:
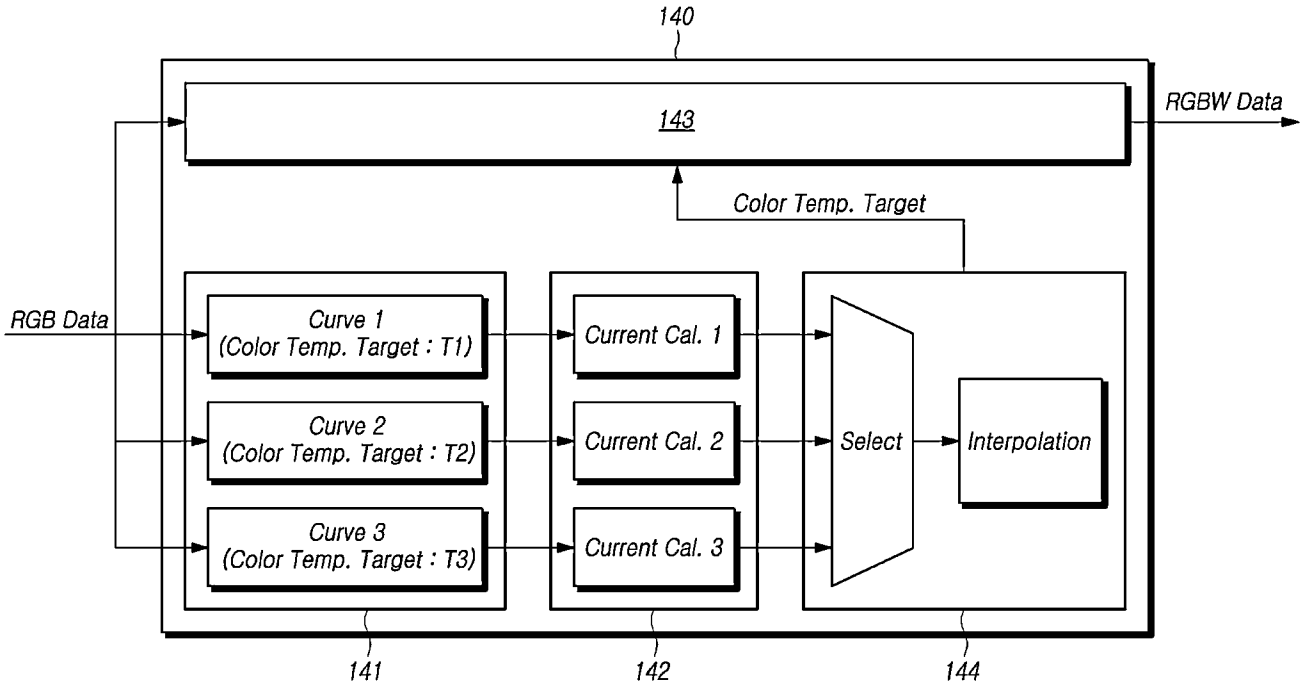
FIG. 8 illustrates another example of a configuration of setting a color temperature of an image by a display device according to embodiments of the present disclosure.
Figure 9:
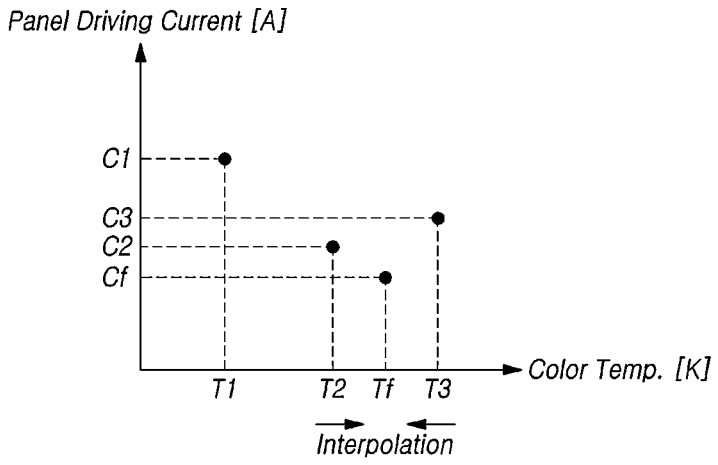
FIG. 9 illustrates another example of a configuration of setting a color temperature of an image by a display device according to embodiments of the present disclosure.

FIG. 8 illustrates another example of a configuration of setting a color temperature of an image by a display device 100 according to embodiments of the present disclosure. FIG. 9 illustrates another example of a configuration of setting a color temperature of an image by a display device 100 according to embodiments of the present disclosure, and illustrates an example of a method of setting a final color temperature target by the controller 140 shown in FIG. 8.

Referring to FIG. 8, the controller 140 may include a candidate data converter 141, a driving current calculator 142, a final color temperature target determiner 144, and a final data converter 143.

The candidate data converter 141 may convert red, green, and blue image data into red, green, blue, and white candidate data signals based on a conversion curve according to a candidate color temperature target.

The driving current calculator 142 may calculate a panel driving current in the cast of displaying an image based on each candidate data signal converted by the candidate data converter 141. The driving current calculator 142 may calculate, for example, the panel to driving current when displaying an image according to the candidate color temperature targets T1, T2, and T3.

The final color temperature target determiner 144 may determine the final color temperature target based on the panel driving current calculated by the driving current calculator 142.

For example, the final color temperature target determiner 144 may select a candidate color temperature target indicating the smallest panel driving current and the second smallest panel driving current among the panel driving currents according to the candidate color temperature targets T1, T2, and T3.

The final color temperature target determiner 144 may set a color temperature between the two selected candidate color temperature targets as the final color temperature target.

For example, as illustrated in FIG. 9, the panel driving currents for each of the candidate color temperature targets T1, T2, and T3 may be C1, C2, and C3. In addition, it may be C1>C3>C2.

In this case, the candidate color temperature target T2 having the minimum panel driving current may be set as the final color temperature target, but in some cases, an interpolation method may be used to set a color temperature Tf located between the candidate color temperature target T2 and the candidate color temperature target T3 as the final color temperature target.

The final color temperature target Tf may be, for example, an intermediate value between the candidate color temperature target T2 and the candidate color temperature target T3. Alternatively, the final color temperature target Tf may be a value between T2 and T3 that is closer to T2 having a smaller panel driving current. The panel driving current for the final color temperature target Tf may be Cf.

By setting, as the final color temperature target, a color temperature located between the candidate color temperature target with the smallest panel driving current and the candidate color temperature target with the second smallest panel driving current, so that it is possible to set a larger number of final color temperature targets by using a smaller number of candidate color temperature targets.

In addition, by setting the final color temperature target within the range of the candidate color temperature target, it is possible to reduce the range in which the final color temperature target is varied according to the image, thereby further preventing the user from recognizing the difference in the image due to the change of the final color temperature target.

The final data converter 143 may convert the received red, green, and blue image data into red, green, blue and white data signals based on the final color temperature target determined by the final color temperature target determiner 144, and may output the converted data signal to the data driving circuit 130.

Figure 10:
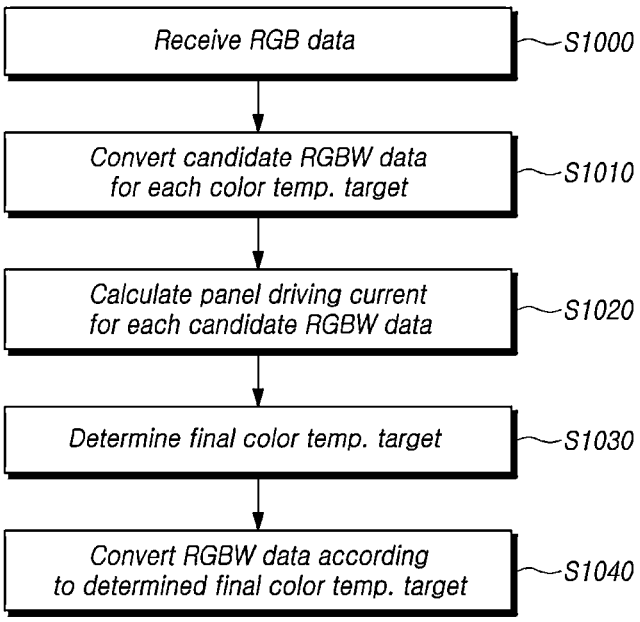
FIG. 10 illustrates an example of a process of a method of driving a display device according to embodiments of the present disclosure.

FIG. 10 illustrates an example of a process of a method of driving a display device 100 according to embodiments of the present disclosure.

Referring to FIG. 10, the display device 100 may receive red, green, and blue image data from the outside and display an image based on the red, green, blue, and white data signals through a display panel 110.

The display device 100 may perform logic capable of reducing power consumption of the display panel 110 in a process of converting image data into a data signal.

For example, the display device 100 receives red, green, and blue image data (S1000).

The display device 100 may convert red, green, and blue image data into red, green, blue, and white data signals for each candidate color temperature target (S1010). The display device 100 may convert one image data into a plurality of candidate data signals according to a plurality of color temperature targets.

The display device 100 may calculate a panel driving current for each candidate data signal (S1020). The display device 100 may calculate, in the case of supplying the data voltage Vdata according to the candidate data signal to the display panel 110 to display an image, a panel driving current supplied to the display panel 110.

The display device 100 may compare the panel driving currents according to the candidate data signals and determine a candidate color temperature target capable of minimizing the panel driving current as a final color temperature target (S1030).

The display device 100 may convert the red, green, and blue image data into red, green, blue, and white data signals according to the determined final color temperature target (S1040).

The display device 100 may supply the data voltage Vdata according to the converted final data signal to the display panel 110, and display an image corresponding to the image data through the display panel 110.

Accordingly, the display device 100 may minimize the panel driving current required to display an image corresponding to image data and reduce power consumption of the display panel 110.

In the above-described embodiments of the present disclosure, in the process of the display device 100 converting image data received from the outside into a data signal, the final color temperature target may be variably set, so that the conversion may be performed so that the panel driving current supplied to the display panel 110 is minimized.

There may be minimized the panel driving current supplied to the display panel 110 according to the image, so that it is possible to reduce the power consumption of the display panel 110.

In addition, the panel driving current is reduced by changing the final color temperature target, so that the efficiency of the display panel 110 may be improved while maintaining the same luminance of the image and maintaining the user's recognition level within a specific range.

In addition, according to embodiments of the present disclosure, even if the characteristics of the light emitting device ED disposed in the subpixel SP vary according to the display panel 110, the final color temperature target is variable set and the image is displayed, so that it is possible to display an image suitable for the characteristics of each display panel 110 with low power consumption.

It will be apparent to those skilled in the art that various modifications and variations can be made in the data driving circuit and the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel on which a plurality of pixels are disposed, each of the plurality of pixels including a red subpixel, a green subpixel, a blue subpixel and a white subpixel;

a data driving circuit configured to supply a data voltage to the plurality of pixels; and a controller configured to control the data driving circuit, wherein a first panel driving current calculated to be supplied to the display panel for displaying a first image in a first candidate color temperature target is less than or equal to a second panel driving current calculated to be supplied to the display panel for displaying the first image in a second candidate color temperature target, wherein a third panel driving current calculated to be supplied to the display panel for displaying a second image in the second candidate color temperature target is less than or equal to a fourth panel driving current calculated to be supplied to the display panel for displaying the second image in the first candidate color temperature target, and wherein the controller is configured to control the data driving circuit such that the data driving circuit is configured to display the first image in the first candidate color temperature target and the second image in the second candidate color temperature target.

2. The display device of claim 1, wherein a data voltage supplied to a pixel representing a test grayscale among the plurality of pixels in the first image is different from a data voltage supplied to a pixel representing the test grayscale among the plurality of pixels in the second image.

3. The display device of claim 2, wherein the first candidate color temperature target is less than the second candidate color temperature target, and at least one of a green data voltage and a blue data voltage supplied to the pixel representing the test grayscale in the first image is greater than at least one of a green data voltage and a blue data voltage supplied to the pixel representing the test grayscale in the second image.

4. The display device of claim 2, wherein the first candidate color temperature target is less than the second candidate color temperature target, and a white data voltage supplied to the pixel representing the test grayscale in the first image is smaller than a white data voltage supplied to the pixel representing the test grayscale in the second image.

5. The display device of claim 2, wherein a luminance of the pixel representing the test grayscale in the first image is the same as a luminance of the pixel representing the test grayscale in the second image.

6. The display device of claim 1, wherein a color temperature measured when the display panel displays a third image is a third color temperature, and the third color temperature is between the first candidate color temperature target and the second candidate color temperature target.

7. The display device of claim 1, wherein a color temperature measured when the display panel displays a third image is a third color temperature, and the third color temperature is equal to one of the first candidate color temperature target and the second candidate color temperature target.

8. A display device, comprising:

a display panel on which a plurality of pixels are disposed, each of the plurality of pixels including a red subpixel, a green subpixel, a blue subpixel and a white subpixel;

a data driving circuit configured to supply a data voltage to the plurality of pixels; and a controller configured to control the data driving circuit, wherein a first panel driving current calculated to be supplied to the display panel for displaying a first image in a first candidate color temperature target is less than or equal to a second panel driving current calculated to be supplied to the display panel for displaying the first image in a second candidate color temperature target, wherein a third panel driving current calculated to be supplied to the display panel for displaying a second image in the second candidate color temperature target is less than or equal to a fourth panel driving current calculated to be supplied to the display panel for displaying the second image in the first candidate color temperature target, wherein the controller is configured to control the data driving circuit such that the data driving circuit is configured to display the first image in the first candidate color temperature target and the second image in the second candidate color temperature target, and wherein a data voltage supplied to a pixel representing a test grayscale when the display panel displays the first image is different from a data voltage supplied to a pixel representing the test grayscale when the display panel displays the second image.

9. The display device of claim 8, wherein a luminance of the pixel representing the test grayscale when displaying the first image is the same as a luminance of the pixel representing the test grayscale when displaying the second image.

10. The display device of claim 8, wherein a color temperature measured when the display panel displays the first image is different from a color temperature measured when the display panel displays the second image.

11. The display device of claim 10, wherein in a case that the first image is displayed with a color temperature measured when displaying the second image, a panel driving current supplied to the display panel increases.

12. A data driving circuit configured to receive a data signal from a controller and output a data voltage to a plurality of pixels disposed on a display panel, wherein a first panel driving current calculated to be supplied to the display panel for displaying a first image in a first candidate color temperature target is less than or equal to a second panel driving current calculated to be supplied to the display panel for displaying the first image in a second candidate color temperature target, wherein a third panel driving current calculated to be supplied to the display panel for displaying a second image in the second candidate color temperature target is less than or equal to a fourth panel driving current calculated to be supplied to the display panel for displaying the second image in the first candidate color temperature target, wherein the controller is configured to convert a first image data corresponding to the first image to a first data signal based on a conversion curve according to the first candidate color temperature target, wherein the controller is configured to convert a second image data corresponding to the second image to a second data signal based on a conversion curve according to the second candidate color temperature target, and wherein a data voltage output to a pixel representing a test grayscale among the plurality of pixels in response to the first data signal is different from a data voltage output to a pixel representing the test grayscale among the plurality of pixels in response to the second data signal.

13. The data driving circuit of claim 12, wherein at least one of a red data voltage, a green data voltage, a blue data voltage and a white data voltage output to a pixel representing the test grayscale in response to the first data signal is different from at least one of a red data voltage, a green data voltage, a blue data voltage and a white data voltage output to a pixel representing the test grayscale in response to the second data signal.

14. The data driving circuit of claim 12, wherein a luminance of the pixel representing the test grayscale into which the data voltage is input in response to the first data signal is the same as a luminance of the pixel representing the test grayscale into which the data voltage is input in response to the second data signal.

15. The display device of claim 1, wherein:

the controller is configured to select the first candidate color temperature target for the first image based on the calculated first and second panel driving currents; and the controller is configured to select the second candidate color temperature target for the second image based on the calculated third and fourth panel driving currents.

16. The display device of claim 1, wherein:

the controller is configured to set the first candidate color temperature target as a final color temperature target for the first image based on the calculated first and second panel driving currents; and the controller is configured to set the second candidate color temperature target as a final color temperature target for the second image based on the calculated third and fourth panel driving currents.

* * * * *